United States Patent [19]

Lindbergh

[11] 4,320,793

[45] Mar. 23, 1982

[54] OUTWARD THRUSTING DOOR WEATHERSTRIP

[76] Inventor: Charles Lindbergh, 10 S. Basilica, Charleston, S.C. 29406

[21] Appl. No.: 128,532

[22] Filed: Mar. 10, 1980

[51] Int. Cl.[3] ..... E05D 15/16; E06B 7/20

[52] U.S. Cl. ..... 160/201; 49/310

[58] Field of Search ..... 49/303, 310, 311, 312, 49/314, 306, 307, 309; 160/201, 204

[56] References Cited

U.S. PATENT DOCUMENTS

| | | | |
|---|---|---|---|
| 724,138 | 3/1903 | Smith . | |
| 882,343 | 3/1908 | Pike . | |
| 1,451,310 | 4/1923 | Smith et al. . | |
| 1,649,070 | 11/1927 | Lerch . | |
| 1,995,013 | 3/1935 | Romaine . | |
| 2,553,461 | 5/1951 | Liebla . | |
| 2,749,582 | 6/1956 | Beck | 49/310 X |
| 2,922,202 | 1/1960 | Kodaras . | |
| 2,987,784 | 6/1961 | Querio . | |
| 3,281,990 | 11/1966 | Nilsson . | |
| 3,331,158 | 7/1967 | Frakes | 49/310 |
| 4,119,133 | 10/1978 | Wolf | 160/201 X |

FOREIGN PATENT DOCUMENTS

| | | | |
|---|---|---|---|
| 306283 | 2/1929 | United Kingdom | 49/309 |

*Primary Examiner*—Philip C. Kannan

*Attorney, Agent, or Firm*—Newton, Hopkins & Ormsby

[57] ABSTRACT

A vertical side weatherstrip for door comprising a jamb mountable shell with moveable sealing strip and strip support rail, an internal means of mechanically holding the sealing strip and support rail recessed into the shell during the operation of the door, and a mechanical means by which the sealing strip with support rail is thrust down and outward against the door edge as the door reaches its closed or full down position. The means for causing the sealing strip to so operate include an internal restraint coil spring, directional guide slots for pins fixed to the shell and passing through the sealing strip support rail, and a bottom plate projecting from the face of the weatherstrip support rail so as to engage and hence translate with the bottom edge of the door as the latter reaches its closed or full down position.

4 Claims, 7 Drawing Figures

OUTWARD THRUSTING DOOR WEATHERSTRIP

BACKGROUND OF THE INVENTION

Garage doors and the like are not easily weatherstripped. They are made in many different styles and usually have large opening gaps at their juncture with the door jamb structure. Ideally, a weatherstripping must not be in contact with the door while the latter is in motion to preclude inhibiting the translation of the door as well as accelerating wear of the weatherstripping. However, once the door reaches its closed position, an effective weather seal should have been established. In practice, stationary vertical side weatherstripping is used. One grouping capitalizes on strip flexibility to maintain a degree of weather proofing while attempting to minimize induced door drag forces and resulting weather seal wear. Another more common group incorporates an inclined door roller guide track such that the door moves laterally against the stationary vertical weather seal as well as vertically during closure operations. The motion sequence is reversed during the subsequent opening of the door. The ideal weather sealing conditions described above are difficult or practically impossible to achieve through such wedging action. In many cases, sustained operations further aggravate the situation necessitating periodic door adjustments. In any event, undesirable frictional forces at the strip/door interface are generated during the initial motion of the door when opening as well as closing. In order to use this "wedging" approach to weather sealing, the door's side mounted guide rollers must be mounted with lateral offsets in a manner increasing in magnitude from the bottom of the top of the door. Consequently, door designs that prohibit such roller offsetting cannot utilize the "wedging" approach to the sealing of vertical side junctures of door and jamb.

This invention overcomes such deficiencies of available vertical weatherstripping means by providing a practical sealing system that is moveable, remaining fully retracted until door closure is achieved. Upon completion of door closure motion, the moveable weatherstrip, promptly accelerates, thrusting against the face of the closed door. A positive pressure seal is consistently achieved. The door may move into its final closed configuration either vertically or at some angle. The door face need not be in one plane as long as the weatherstrip is formed to the same geometry such that upon extending upon the door face, no gaps remain.

No frictional drag forces or wear of the contacting weatherstrip surface occurs as there is never any relative motion between the door and the weather strip while these elements are in contact. My weatherstripping system relates to essentially all known industrial as well as residential overhead door systems. It can also be applied to laterally operating closure systems as gravity is not a prerequisite operating force component. Similarly, it can be used to provide a non-motion interferring positive weather seal on all edges of a door panel, including the bottom where the system may be recessed into the door if threshhold obstructions cannot be tolerated. My weatherstrip system can be readily applied to existing installed door systems as well as currently with new systems.

A preferred embodiment of the outward thrusting weatherstrip system of the invention comprises such devices as used to weather seal the vertical opening between the door jamb and the side edges of an overhead residential garage door system.

Figure 1:
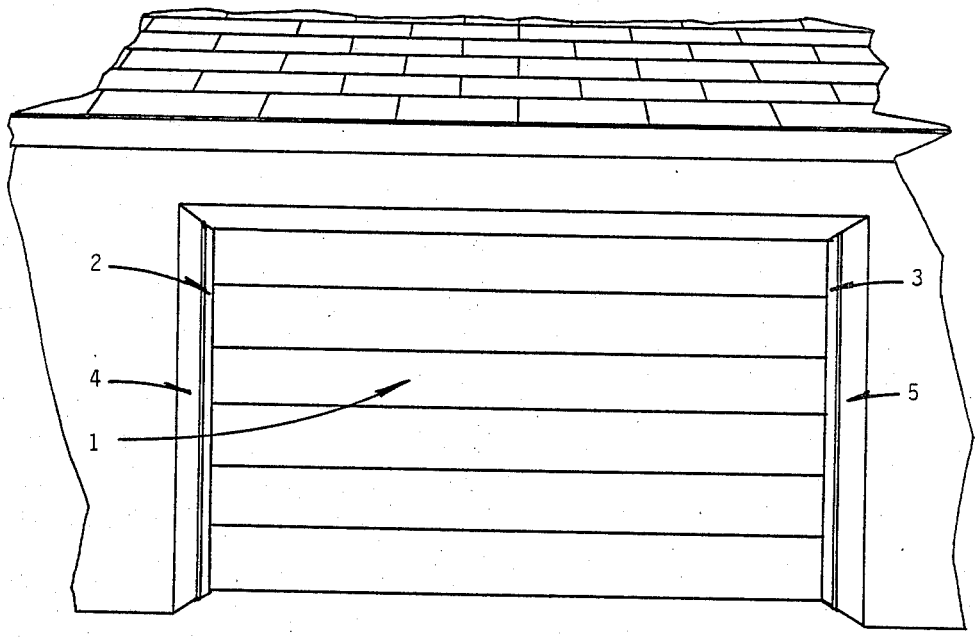
FIG. 1 illustrates the general position of the weather sealing system of this invention as viewed from the exterior side of a closed overhead residential garage.

FIG. 1 is a schemtic of an exterior view of an embodiment of the invention as installed to seal the vertical jamb/door joints of a residential garage door system. The segmented panel door 1 is in its closed configuration. The weatherstripping system of this invention 2, 3 is applied to both door jambs 4, 5 on their sides adjacent to the door panels.

Figure 2:
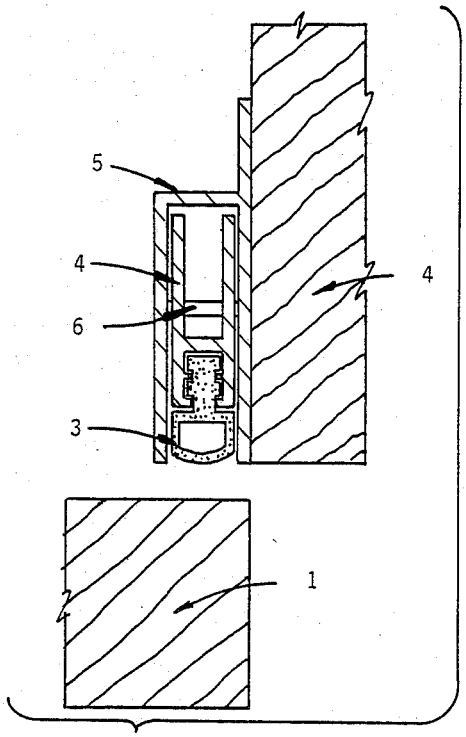
FIG. 2 is the cross-sectional view A—A of the weather sealing system as designed in FIG. 1 as it would appear at all times, except when the door is in its closed position.

FIG. 2 illustrates the cross-sectional view of the weather sealing system identified as Section A—A in FIG. 1 as the system would exist during all door configurations except that of fully closed. The illustrated components of the system 2 include the weather strip 3 and support rail 4 as fully recessed into a shell 5 which in turn are screw attached to the door jamb 4. The section also shows one of several pins 6 used to constraint the motion of the weather sealing strip 3 and the support rail 4 relative to the shell 5.

Figure 3:
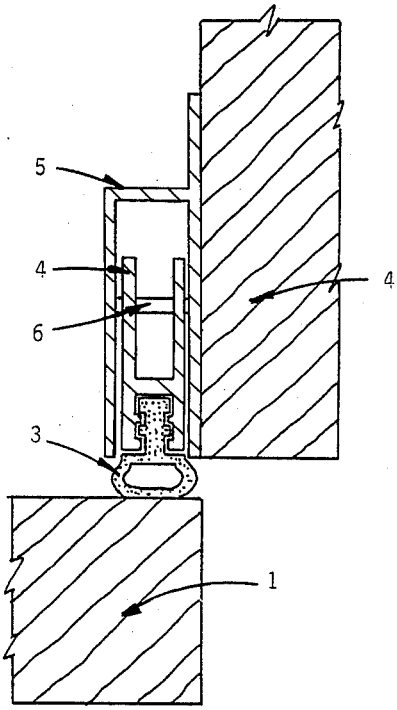
FIG. 3 is the cross-sectional view A—A of the weather sealing system as designated in FIG. 1 as it would appear when this door is in its closed position.

Upon full closure of the door 1, a mechanical coupling of the latter and the weather seal support rail 4 result in the weather seal 3 as fixed to support rail 4 thrusting outward from its stationary shell 5 and firmly seating against the nearby surface of the door 1. This motion is as directed by the constraint of the shell 5 and mounting pins 6 acting in spaced diagonal slots placed within the support rail 4. FIG. 3 illustrates the resulting configuration effectively sealing the jamb/door juncture. The weatherstripping seal 3 is made of a conventional durable weatherstripping material such as neoprene. The shell 5 and support rail 4 would usually be made of extruded aluminum. The mounting pins 6 would usually be made of steel.

Figure 4:
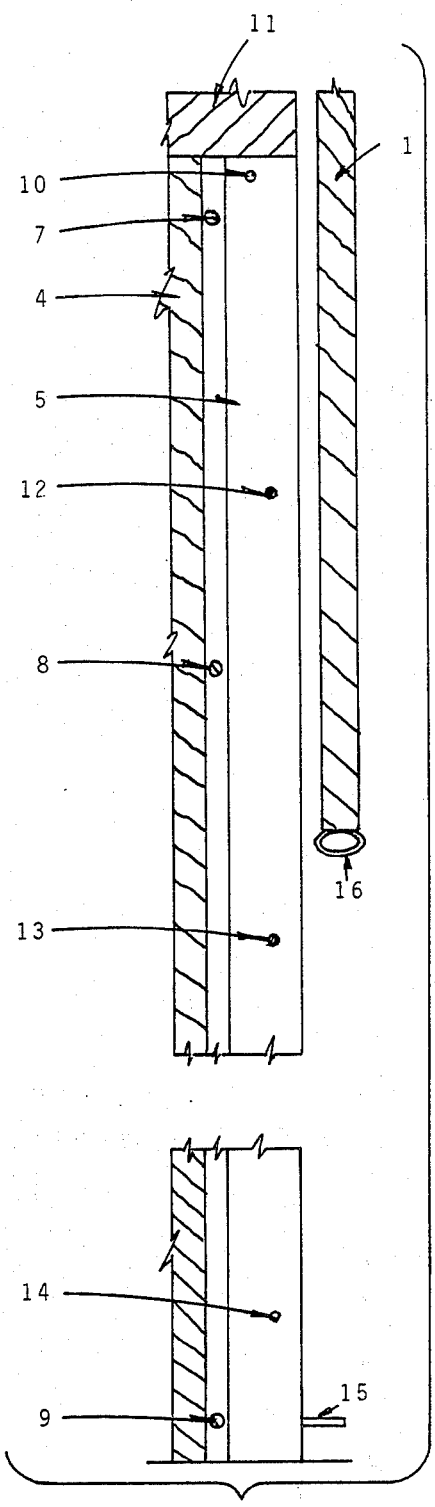
FIG. 4 is the side view of the weather sealing system as it is installed on the left door jamb in FIG. 1. The figure also illustrates a partial sectional view of the door in an intermediate operating position.

FIGS. 4 through 7 illustrate other structural features as well as the overall operation of the weather sealing system 2. FIG. 4 is a partial side view of the weather sealing system 2 as applied to the left door jamb 4 in FIG. 1. The system extends from the floor to the upper headers 11. The shell 5 is attached to the jamb 4 by screws including those illustrated 7, 8, 9. The shell is equipped with a pin 10 that restrains the upper end of an internal spring to be illustrated in FIG. 5. Other through-pins 12, 13, 14 restrain motion of the inner weather seal rail 4 relative to the shell 5. A sideview of the door 1 in a partially open configuration is also shown. A conventional bottom weather seal 16 is indicated. In this view, the weather sealing strip is fully recessed into the shell 5 leaving the full operating gap between the jamb 4 and door 1.

Figure 5:
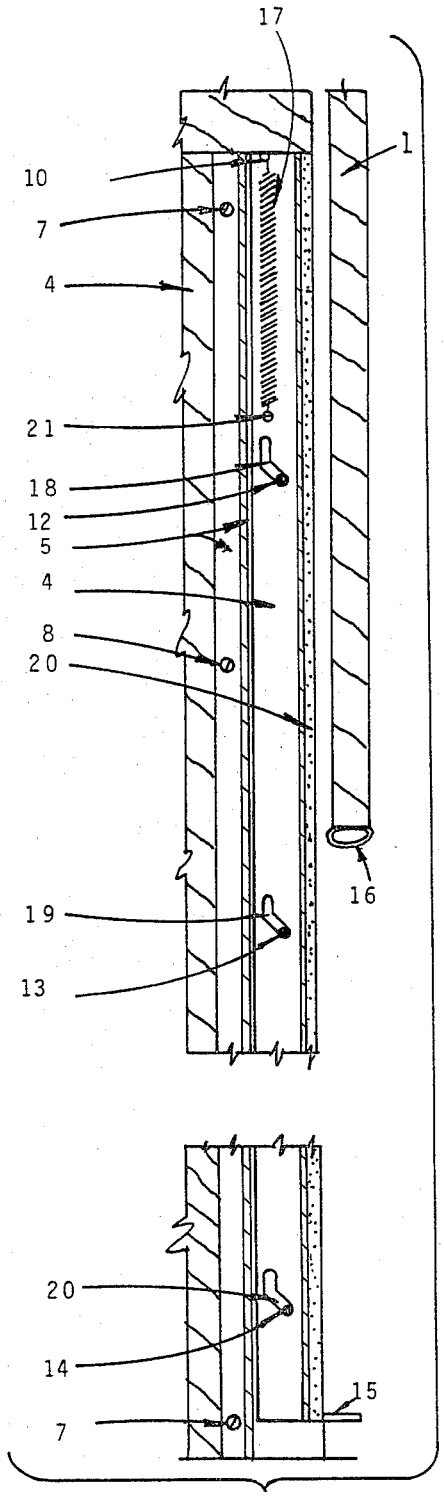
FIG. 5 is a vertical cross-section of the weather sealing system of FIG. 4 as formed as section B—B designated in FIG. 2. The door is in a partially opened configuration.
Figure 6:
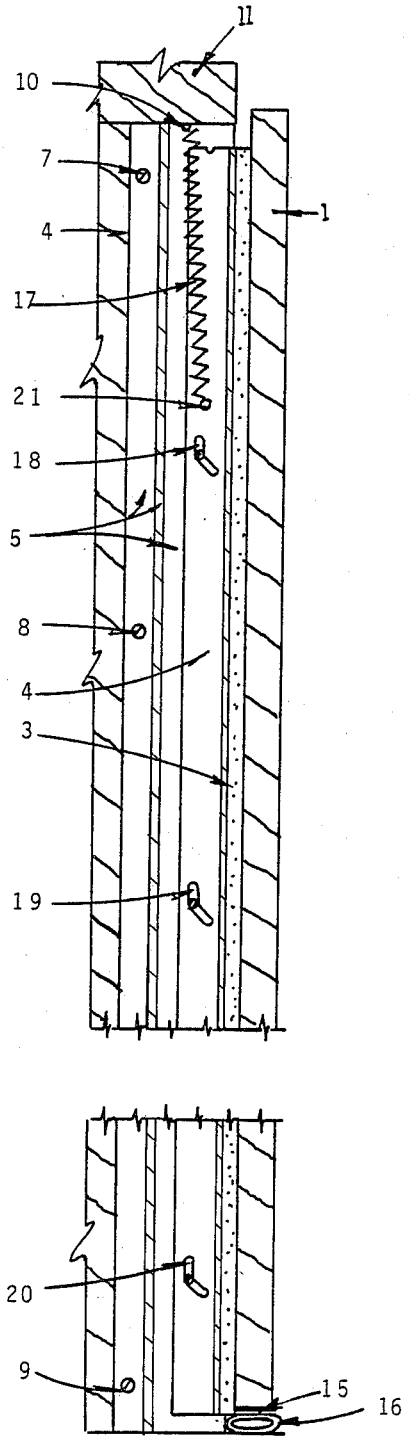
FIG. 6 is a vertical cross-section of the weather sealing system of FIG. 4 as formed as Section C—C designated in FIG. 3. The door is in its normal fully closed configuration.

A cross-section of the system in FIG. 4 taken as indicated as section B—B in FIG. 2 is shown in FIG. 5. In this cut-away view, the internal weatherseal support rail 4 and attached weather seal 3 are revealed. Three of several regularly spaced rail guide slots 18, 19, 20 are shown that, due to the restraint of penetrating pins 12, 13, 14 attached to the stationary shell 5, cause the support rail 4 and attached seal 3 to translate down and outwards when a downwards acting force is applied to the support rail 4. Such a force occurs when the door 1 reaches its full closed position and "bears upon" the rail's bottom projection 15. The horizontal component of the guide slot's diagonal length equates to the seal lateral motion necessary for effective sealing, as FIG. 6 illustrates. The guide slots also have a vertical segment. Normally a closing door is arrested by a latch that allows a very small return motion before fixing the door 1 in its final closed configuration. The vertical slot segment allows the seal 3 to translate with the door 1 down through this slight distance and in reverse to the static closed configuration without inducing frictional forces and component wear while maintaining the desired positive seal.

Figure 7:
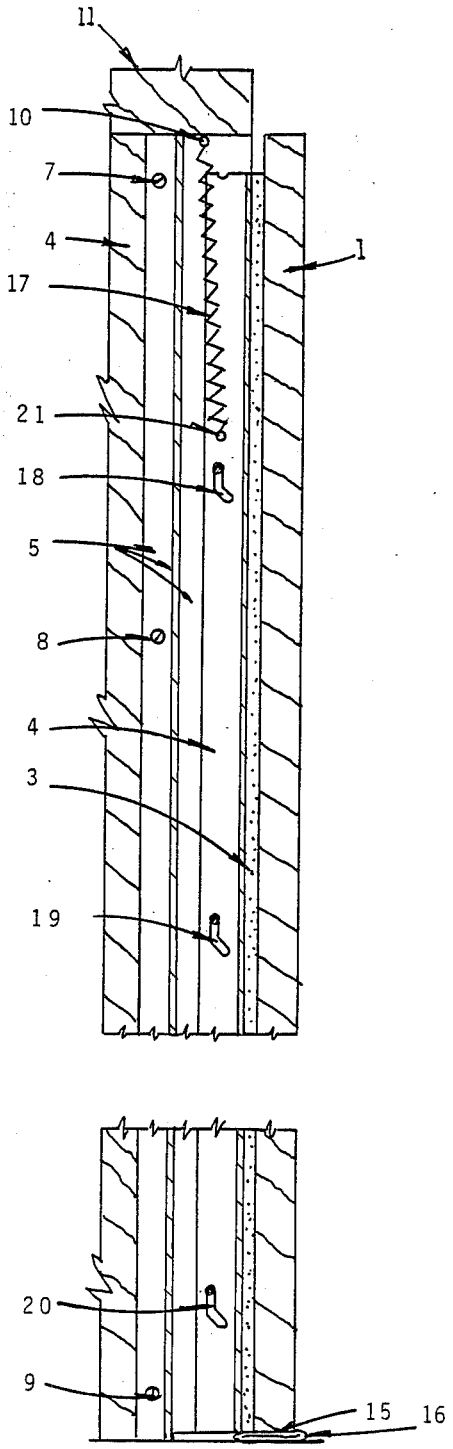
FIG. 7 is the vertical cross-sectional view of FIG. 6 except that the arrangement is that of the door in its full down overtravel position as reached prior to its attaining the normal fully closed configuration of FIG. 6.

FIG. 7 illustrates this use of the guide slot's vertical segment by showing the system's configuration in the door's 1 maximum down configuration. Referring again to FIG. 5, an extensional spring 17 is connected between a pin 10 fixed to the shell 5 and a pin 21 attached to the inner support rail 4. This spring 17 acts to maintain the support rail 4 and attached seal 3 in their full upwards, and hence fully recessed, position. Only when the closing door 1 impacts the support rail's bottom projection 15 is the spring force overcome and the support rail 4 and attached seal 3 dropped vertically and, hence, outwards to effect the desired sealing. As the door 1 commences to open again, the spring 17 acts to immediately raise the support rail 4 now relieved of its door constraint. Accordingly, the contact between the weather seal 3 and door 1 is immediately broken and the support rail 4 and attached seal 3 are restored to their fully recessed position.

The spacing, and hence number, of restraining pins 12, 13, 14 depends upon the structural support of the support rail required in order to establish and maintain necessary sealing contact pressures.

An overhead door system was featured in this embodiment. However, a laterally rolling door could be sealed with the same weather sealing system. Further, all sides of a closed door could be sealed in the same manner. All that is required in the various cases is a means of mechanically coupling the door as it reaches its closed configuration with the operating support rail 4 of the sealing strip 3.

I claim:

1. A weatherstripping arrangement for a sliding closure comprising a fixed jamb extending along the path of movement of the sliding closure near one edge thereof, a shell fixed to said jamb and extending lengthwise thereof and having a longitudinal opening facing the plane of said closure, a weatherstrip rail movably held within the shell and being substantially coextensive lengthwise with the jamb and shell, a compressible weatherstrip element attached to the rail and being substantially coextensive lengthwise with the rail and adapted in an inactive position to lie wholly inside of the shell and in an active position to project through the opening of the shell and outside of the shell to abut the opposing surface of the closure, spring means connected with the rail and biasing the rail and weatherstrip element to said inactive position inside of the shell, a substantially rigid lateral projecting element on the rail adjacent to one end of the rail in the path of movement of the leading edge of the sliding closure and adapted to be engaged by the leading edge when the sliding closure is approaching a fully closed position, at least a pair of fixed pins on the shell across the longitudinal axis of the rail and shell and within the opening of the shell and being spaced apart longitudinally of the shell, at least a pair of coacting cam slots in the rail receiving said fixed pins therethrough cammingly and having portions extending longitudinally of the rail and shell and portions extending at an oblique angle to the longitudinal axis of the rail and shell and toward the weatherstrip element, and a compressible resilient seal on the leading edge of the sliding closure for abutment with an opposing surface when the sliding closure is in a fully closed position, said longitudinal slot portions enabling overtravel of the sliding closure beyond a normal fully closed position followed by slight return travel to the normal fully closed position without inducing sliding motion of the weatherstrip element relative to the closure and without loss of sealing contact between the weatherstrip element and closure, and said fixed pins being located substantially at junctures of the longitudinally extending and oblique angle portions of the cam slots when the sliding closure is in the normal fully closed position, said pins moving substantially to the ends of the longitudinal cam slot portions when the closure is in the overtravel position and moving substantially to the ends of the oblique angle cam slot portions when the rail and weatherstrip element are in the biased inactive position.

2. A weatherstripping arrangement for a sliding closure as defined in claim 1, and said spring means comprising a retractile spring within said shell having one end attached to said rail.

3. A weatherstripping arrangement for a sliding closure as defined in claim 1, wherein said closure is a vertically moving closure and said compressible resilient seal is on the lower edge of the closure for abutment with a floor surface or sill.

4. A weatherstripping arrangement for a sliding closure as defined in claim 3, and the sliding closure comprising a multi-articulated panel garage door.

* * * * *